US005312100A

United States Patent [19]

Ilacqua et al.

[11] Patent Number: 5,312,100

[45] Date of Patent: May 17, 1994

[54] HOCKEY STICK HANDLE WITH DETACHABLE BLADE AND METHOD OF MANUFACTURE

[75] Inventors: Anthony Ilacqua, Rochester; Martin P. Schooping, Hamlin, both of N.Y.

[73] Assignee: Brimms Inc., Tonawanda, N.Y.

[21] Appl. No.: 48,223

[22] Filed: Apr. 20, 1993

[51] Int. Cl.[5] ..... A63B 59/14

[52] U.S. Cl. ..... 273/67 A; 273/67 R; 273/326

[58] Field of Search ..... 273/67 A, 73, 80, 72, 273/67 R, 81.4, 326, DIG. 2; 15/143

[56] References Cited

U.S. PATENT DOCUMENTS 3,971,094 7/1976 Solf et al. ..... 15/143 R 4,361,325 11/1982 Jansen ..... 273/67 A 4,600,192 7/1986 Adachi ..... 273/67 A 4,684,130 8/1987 Drolet ..... 273/67 A

*Primary Examiner*—Mark S. Graham

*Attorney, Agent, or Firm*—Hodgson, Russ, Andrews, Woods & Goodyear

[57] ABSTRACT

A hollow game stick handle (12) formed as an extruded member and adapted to mate with a molded hockey stick blade (14) having an improved socket (18) for holding the handle to thereby provide a hockey stick (10) for use in street hockey, ice hockey, and the like,, is described. The handle is an elongated member having a substantially rectangular cross-section with a reduced wall thickness that approximates the weight and feel of a wooden hockey stick handle.

3 Claims, 3 Drawing Sheets

HOCKEY STICK HANDLE WITH DETACHABLE BLADE AND METHOD OF MANUFACTURE

The present invention relates to game handles having a detachable blade, and more particularly to an improved hockey blade that is detachable from an improved hollow handle or shaft comprising a hockey stick used in street hockey, ice hockey, and the like. The term "hockey stick" refers to a handle assembled to a blade to provide a device used for hockey and the like, while the term "hockey stick handle" refers to a handle without the blade.

The hockey blade is a molded member and includes a blade portion and a shank portion having an improved socket for holding the handle. The hollow handle is an extruded member having an improved cross-sectional construction that gives the handle greater resistance to breaking, bending and cracking than prior art handles. Hollow handles of this type may also be used, for example, as exercise wands, lacrosse stick handles, and curling broom handles.

During the course of a hockey game, a hockey stick is subjected to a variety of stresses that have a tendency to bend, break and crack the handle. It is therefore desirable to make the handle both durable and flexible and able to avoid permanent deformation and breakage due to impact while retaining the feel and weight characteristics of a wooden handle. In that respect, hockey players prefer hockey stick handles having substantially rectangular cross-sections. This affords the player with a comfortable grip in addition to providing him with greater awareness of and control over the orientation of the blade during play, as compared with, for instance, a handle having a circular or square cross-section.

With a rectangular cross-sectioned handle defined by a pair of parallel, planar broad sides connected by a pair of parallel, planar narrow sides, the majority of the forces generated during the course of play are directed against the narrow sides, which are generally perpendicular to the plane of the blade. When the broad sides and narrow sides have generally the same wall thickness, cracking and breaking of the handle normally occurs on a corner where one broad side meets one narrow side, or in the wall of the narrow side, where stresses are most concentrated.

In order to make hockey stick handles more durable, it has thus been found necessary to increase the wall thickness of the broad and narrow sides as well as the corners joining the sides. For example, U.S. Pat. No. 4,361,325 to Jansen, which is assigned to the assignee of the present invention and is incorporated herein by reference, describes a hollow hockey stick handle made from a plastic material and having a substantially rectangular cross-section. The outer and inner surfaces are arcuately shaped for increased strength and improved fracture resistance. The sidewalls and corners are of a non-uniform thickness such that the minimum wall thickness of the narrow sides is greater than the minimum wall thickness of the broad sides, while the maximum wall thickness of the corners is greater than the minimum wall thickness of both the narrow and broad sides.

The hockey stick handle of the present invention has a reduced wall thickness that enables the handle to approximate the weight and feel of a wooden hockey stick handle. The present hockey stick handle also is flexible to provide an acceptable amount of "whip" to help propel the hockey puck during a shot. Further, the present hockey stick handle is detachable from its associated hockey blade so that should either the blade or the handle become damaged and broken and unusable, the damaged part can be replaced. In addition, either the blade or the handle can serve as the male member which is mated to the female holding member provided by the other part to form the complete hockey stick. This provides versatility in the manufacturing process.

In that respect, until the present invention it has been the practice to mold the socket in the shank portion of a hockey blade, which serves as the holder for handles and shafts and the like, using a three-piece slide mold. The mold is comprised of two mold sections that are joined together to form the shape of the blade and the shank. A slide or rod-like member is positioned between the mold sections to create a void that serves as the socket in the shank. This three-step molding process increases the cycle time for forming the blade, which increases molding costs.

In the present invention, the handle receiving socket is formed without use of the slide or rod-like member. In addition to reducing the cycle time of the molding process, elimination of the slide member results in a less costly mold and a reduction in the plastic material used. Furthermore, the mold can be easily adapted to provide the shank portion as a male member that fits inside a hollow hockey stick handle as the female receiving member.

OBJECTS OF THE PRESENT INVENTION

Accordingly, an object of the present invention is to provide a new and improved hollow handle useful as a game handle.

Another object of the present invention is to provide a hockey blade for a hockey stick made from a molded plastic material and having a new and improved socket for holding the hockey stick handle.

Still further, it is an object of the present invention to provide a hollow hockey stick handle as a male member that is detachably mated with a hockey blade having the new and improved socket to provide a hockey stick so that either member can be removed and replaced should that member become damaged and unusable.

Yet another object of the present invention is to provide the new hockey stick handle, preferably made of an extruded metal material, and having a construction that is durable in use and that has an overall weight which is similar to or lighter than a wooden handle.

A still further object of the present invention is to provide a new and improved hockey blade having a socket that serves as a holder for a hockey stick handle, wherein the socket is formed using a two-piece mold that eliminates the need for a third slide member to form the socket.

These and other objects will become increasingly apparent to those of ordinary skill in the art by reference to the following description and to the drawings.

SPECIFIC DESCRIPTION

Figure 1:
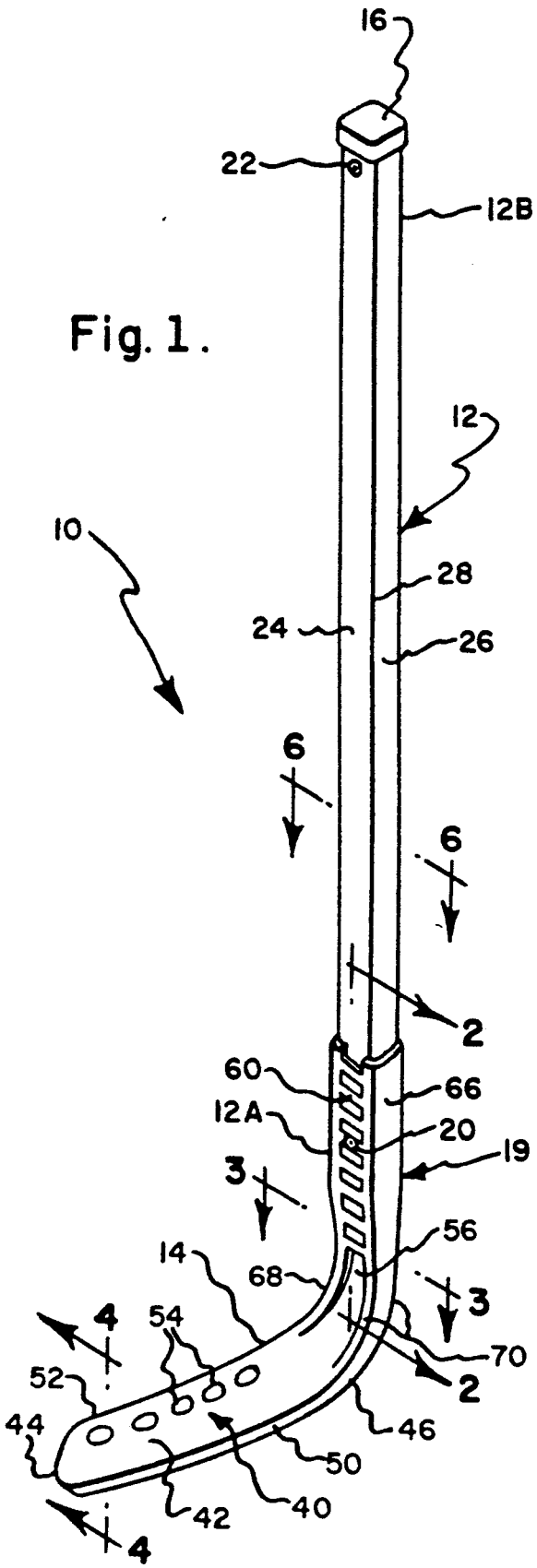
FIG. 1 is a perspective view of the preferred hockey stick 10 of the present invention including a hockey stick handle 12 mated to a shank portion 48 of a hockey blade 14.

Referring now to the drawings, there is shown in FIG. 1 a hockey stick 10 according to the preferred embodiment of the present invention and comprising an elongated, hollow shaft or handle 12 mated with a hockey blade 14 secured at a proximal end 12A of handle 12 and having a plastic cap or grip 16 mounted at an opposite, distal end 12B. The proximal end 12A of handle 12 is preferably mated with a socket 18 (FIGS. 5 and 7) provided in a shank portion 48 of hockey blade 14 for holding the handle 12 and secured in place by a screw 20 or other suitable fastening means. Cap 16 may be provided with a male protrusion (not shown) that mounts inside the hollow distal end 12B and is secured in place by screw 22 or other suitable securing means.

Handle 12 is straight and can be of any length to suit a variety of player sizes, from small children to grown adults. It is preferably an extrusion of a lightweight, high strength metal material such as aluminum alloy 6061-T6, although plastic materials having the desired characteristics may also be used. Independent of the material of construction, handle 12 has the requisite strength and rigidity that is suitable for use as a hockey stick handle and that is capable of being worked, molded, extruded or otherwise made to conform to the configuration that is to be presently described in detail, and having the necessary strength and toughness to resist breaking or cracking in use.

Figure 6:
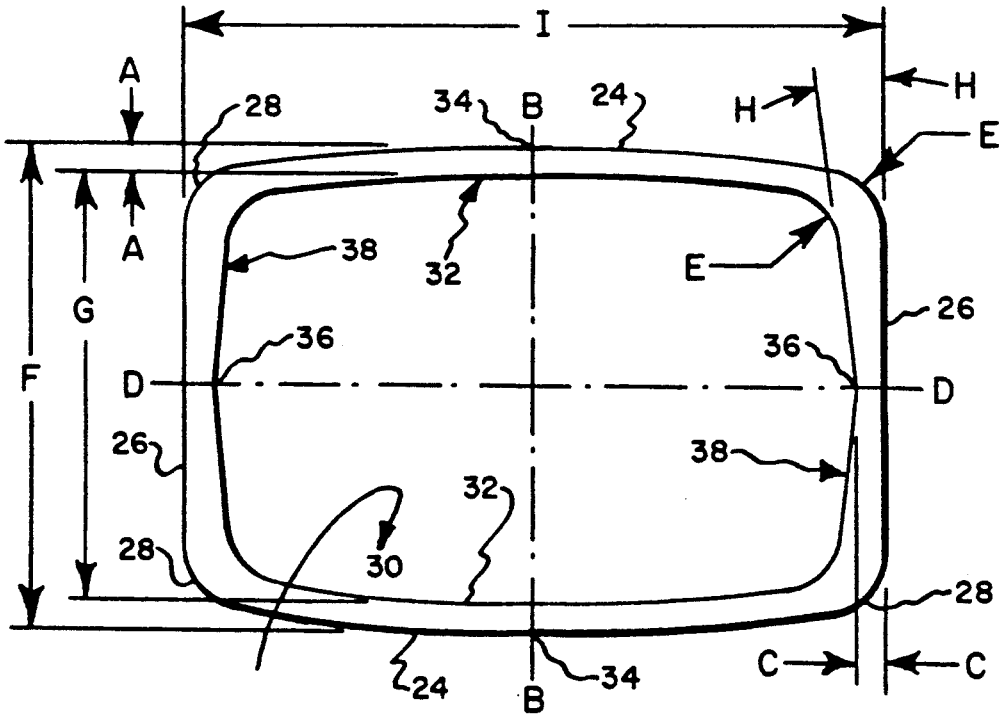
FIG. 6 is a cross-sectional view of handle 12 along line 6—6 of FIG. 1, on an enlarged scale.

As shown in the cross-sectional view in FIG. 6, handle 12 has a generally rectangular cross-section defined by a pair of opposed, nonplanar, broad sidewalls 24 interconnected with a pair of opposed, planar, narrow sidewalls 26. The interconnections are made by four rounded corner portions 28 and the interior of handle 12 defines a hollow core 30.

The broad sidewalls 24 have a convex outer shape with a generally uniform wall thickness A defined by a similarly shaped concave inner surface 32 and extending from a midpoint 34 along the short axis B—B of handle 12 to the corners 28. The thickness of the narrow sides 26 is non-uniform. Each narrow sidewall 26 is thinnest at C, substantially its midpoint 36 along the long axis D—D of handle 12 and has an angled inner surface 38 that provides the sidewalls 26 with increased thickness substantially symmetrically on opposite sides of the midpoints 36. The maximum thickness of the broad sidewalls 24 occurs where they form into adjacent corners 28. The minimum thickness C of the narrow sides 26 is somewhat greater than the generally uniform thickness A of the broad sides 24, and the thickness E at the corner portions 28 is greater than the minimum thickness C and the uniform thickness A. The generally uniform thickness of the sidewalls 24 and the non-uniform thickness of the sidewalls 26 and corners 28 length of the handle 12.

By way of example of a typical handle 12, the broad sidewalls 24 have a wall thickness A of about 0.038 inch, and the narrow sidewalls 26 have a midpoint 36 thickness of about 0.040 inch with the corner portions 28 having a thickness at E of about 0.10 inch. The distance F between opposite outer surfaces of the sidewalls 24 at the midpoint 34 is about 0.779 inch while the distance G between opposite inner surfaces 32 of the sides 24 along the short axis B—B is about 0.703 inches. This provides about a 5° widening taper as indicated at H for the inner surface 38 as it extends to the thickness E at the corners 28. The distance I between opposite outer surfaces of planar sides 26 is about 1.125 inches.

From the foregoing description, it can be seen that handle 12 has a substantially rectangular cross-section along its length and as shown in FIG. 1 mated with the hockey blade 14, the proximal end 12A is mounted in socket 18 (FIGS. 5 and 7) of the shank portion 48 of blade 14 to form the hockey stick 10 of the present invention with the broad sidewalls 24 generally parallel with the plane of inner face 40 and back face 41 (FIG. 5) of blade 14. This is the configuration most preferred by hockey players and therefore the narrow sidewalls 26 have the greatest wall thickness where it is needed to absorb stresses created in handle 12, for example, as a result of an impact with a hockey puck (not shown) during play. This results in improved resistance to cracking and breaking while maintaining an acceptable amount of flex to handle 12, which is necessary when a hockey player shoots a puck.

Figure 4:
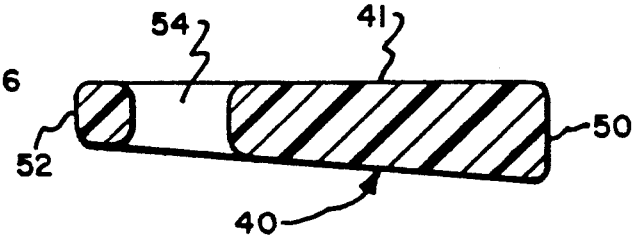
FIG. 4 is a cross-sectional view along line 4—4 of FIG. 1.

As generally shown in FIG. 1, the hockey blade 14 is mounted on the proximal end 12A of handle 12 and includes a blade portion 42 having the opposed faces 40 and 41 between a toe 44 and a heel 46 and the shank portion 48 extending from the heel 46 at an obtuse angle of between about 120 and 150 degrees. The bottom edge 50 of the blade portion 42 (FIG. 4) is somewhat wider than the top edge 52 along the length of the blade portion 42 for wear on non-ice surfaces such as in street hockey and the like. The blade portion 42 is also bent to give the face 40 a curved surface adjacent the toe 44 which helps a player carry a puck along the playing surface and for control in aiming and shooting the puck. A plurality of oval opening 54 are provided through the blade portion 42 adjacent the top edge 52 to aid in decreasing air resistance as hockey blade 14 is swung to pass or shoot.

Figure 5:
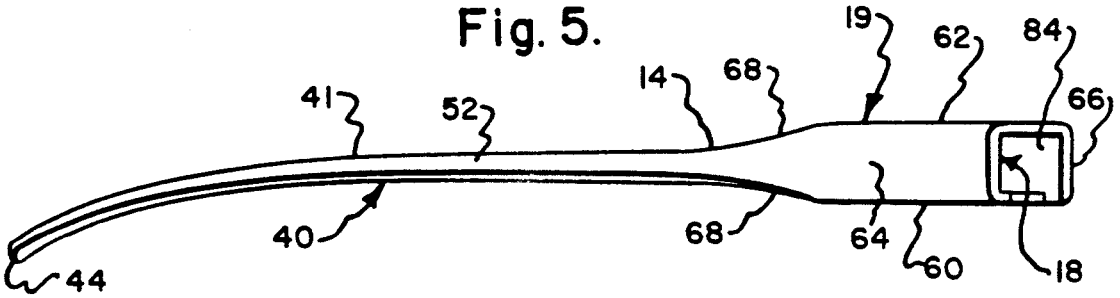
FIG. 5 is a top plan view of hockey blade 14 with the hockey stick handle 12 removed.

As shown in FIGS. 1 and 5, the opposed faces 40 and 41 comprising blade portion 42 form into upwardly and outwardly tapering sidewalls 56 and 58 (FIGS. 2 and 7) that extend into parallel and planar broad sidewalls 60 and 62 provided between parallel and planar narrow lateral sidewalls 64 and 66, to thereby form socket 18 having a generally rectangular cross-section. Opposed pairs of upper and lower stiffening ribs 68 and 70 extend along the shank 48 between heel 46 and socket 18 to provide support to the shank 48. A series of alternating indentations 72 and 74 having generally rectangular cross-sections (FIG. 1) terminating at curved end walls (FIGS. 2 and 7) are provided in the tapered sidewalls 56 and 58, respectively extending to the sidewalls 60 and 62.

Figure 2:
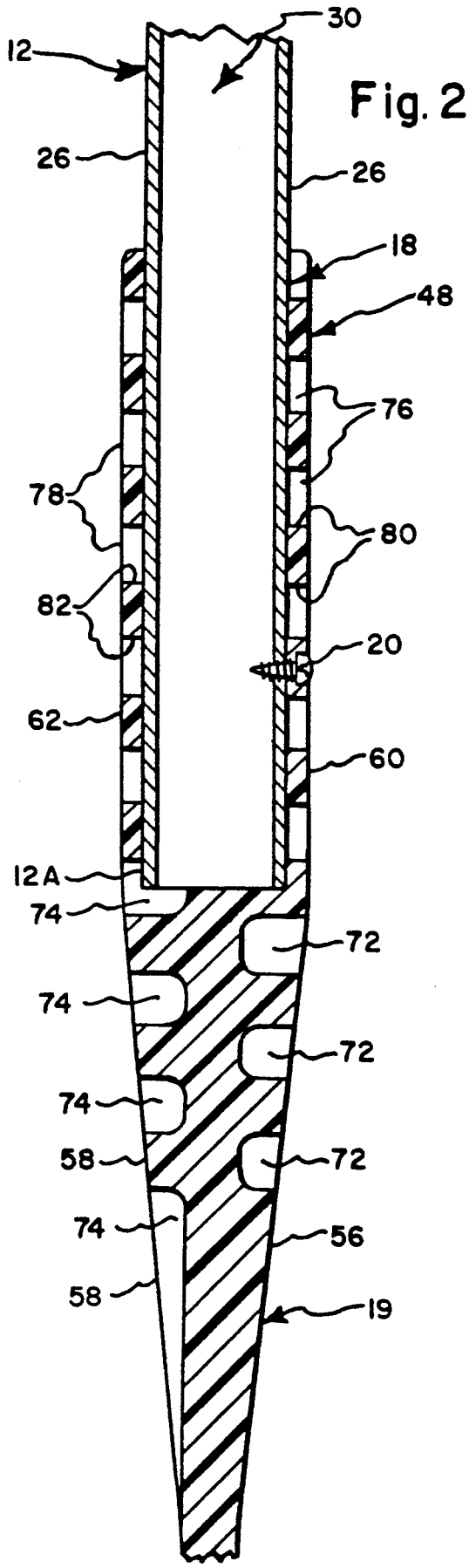
FIG. 2 is a fragmentary, longitudinal cross-sectional view along line 2—2 of FIG. 1, on a enlarged scale, and showing handle 12 mounted inside a socket 18 of the shank portion 48 of hockey blade 14.
Figure 3:
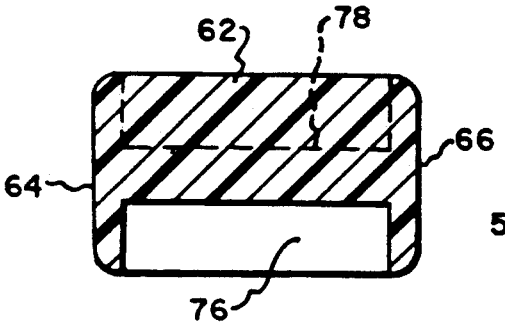
FIG. 3 is a cross-sectional view along line 3—3 of FIG. 1.
Figures 7, 8, 9:
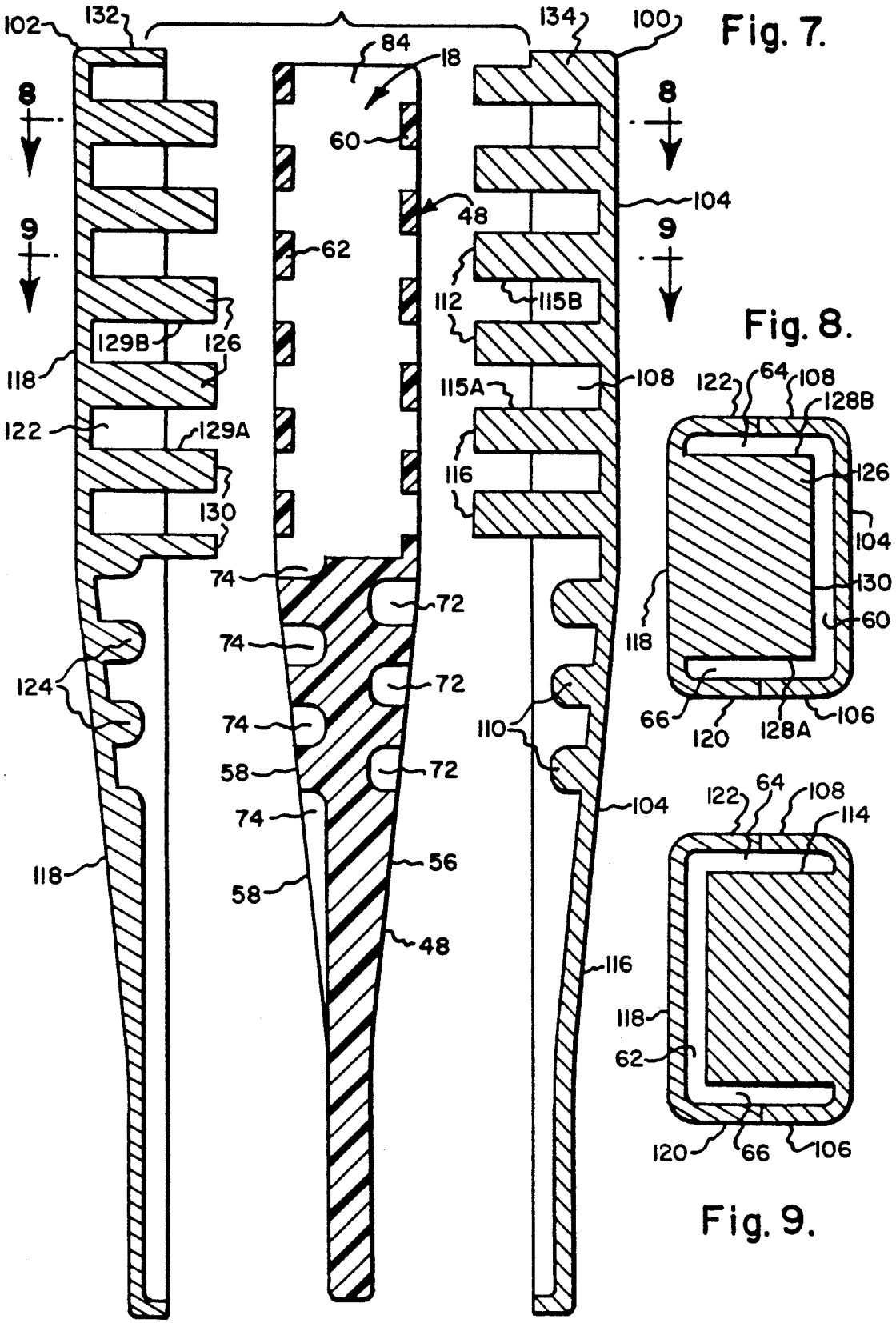
FIG. 7 is a schematic of a mold comprised of mating mold sections 100 and 102 having respective overlapping protrusions 112 and 126 that provide the socket 18 in shank portion 48 of hockey blade 14.
FIG. 8 is a cross-sectional view along line 8—8 of FIG. 7.
FIG. 9 is a cross-sectional view along line 9—9 of FIG. 7.

As shown in cross-section in FIGS. 2 and 7, the broad sidewalls 60 and 62 are provided with spaced apart openings 76 and 78, respectively, each having a rectangular shape forming parallel, planar edges 80 and 82. The plane of edges 80 have an overlapping relationship with the plane of edges 82 and are formed by the molding process of the present invention, which will be described in detail shortly. The rectangular-shaped openings 76 and 78 do not extend the entire width of the broad sidewalls 60 and 62 and in that manner, provide a thickness to the lateral sidewalls 64 and 66. An end opening 84 in shank 48 leads into socket 18 and provides for mounting the proximal end 12A of handle 12 inside socket 18 of hockey blade 14 to form the preferred hockey stick 10 shown in FIG. 1.

Blade 14 is constructed as a molded member, preferably made from a synthetic plastic material having the requisite strength, rigidity and formability, such as HDPE reinforced with fiberglass. In addition, blade 14 may be manufactured from any composite material or synthetic material, or combination thereof, suitable for use as a hockey blade and capable of being molded and having the necessary strength and toughness to withstand the forces generated in striking a hockey puck and similar objects.

Accordingly, blade 14 is made using a mold having mating right and left mold sections 100 and 102 as viewed in FIGS. 7 to 9, which provide the shape of the blade portion 42 and the shank 48 including the socket 18 as previously described. As viewed in FIG. 7, mold section 100 is comprised of right lateral sidewall 104 extending between front and back walls 106 and 108 (FIGS. 8 and 9) with lateral sidewall 104 comprising a plurality of rectangularly shaped lower protrusions 110 having curved terminal ends that serve to form indentations 72 in sidewall 56 of shank 48 and upper protrusions 112 comprised of parallel, planar sidewalls 114A and 114B (FIG. 9) which meet parallel, upper and lower sidewalls 115A and 115B with protrusions 112 extending to normal end faces 116 (FIGS. 7 and 9). In a similar manner, mold section 102 is comprised of left lateral sidewall 118 extending between front and back walls 120 and 122 (FIG. 9) with lateral sidewall 118 comprising a plurality of rectangularly shaped lower protrusions 124 having curved terminal ends that serve to form indentations 74 in sidewall 58 of shank 48 and rectangularly shaped upper protrusions 126 comprised of parallel, planar sidewalls 128A and 128B (FIG. 8) which meet parallel, planar, upper and lower sidewalls 129A and 129B with protrusions 126 extending to normal faces 130 (FIGS. 7 and 8).

When mold sections 100 and 102 are joined to provide the mold for blade 14, protrusions 112 and 126 are moved into an overlapping relationship having a sliding clearance between the protrusions 112 and 126. In this position, faces 116 of protrusions 112 are spaced from opposed lateral sidewall 118 of mold section 102 and faces 130 of protrusions 126 are spaced from opposed lateral sidewall 104 of mold section 100. This provides respective broad sidewalls 60 and 62 (FIGS. 8 and 9). In a like manner, opposed planar sidewalls 114A and 114B of protrusions 112 are spaced from front and back walls 106 and 108 of mold section 100 and front and back walls 120 and 122 of mold section 102, while opposed planar sidewalls 128A and 128B of protrusion 126 are similarly spaced from mold walls 106, 108, 120, and 122 (FIG. 8) to form lateral sidewalls 64 and 66 of shank 48. Finally, the planar upper and lower sidewalls 129A and 129B of protrusions 126 overlap in a sliding clearance with the planar upper and lower sidewalls 115A and 115B of protrusions 112 to completely occupy the space providing the socket 18 in shank 48. This overlapping relationship continues to an upper end wall 132 provided on mold section 102 that mates with an uppermost protrusion 134 on mold section 100 to form the opening 84 leading into socket 18.

In this manner, blade 14 including the socket 18 formed in the shank 48 is made using the two-piece mold. Socket 18 serves to receive and hold the hockey stick handle 12 with the proximal end 12A abutting the end of the socket 18 (FIG. 2). Handle 12 is sized to be press-fitted into socket 18 and is preferably held in place by screw 20 or a similar fastening means. Then, should the hockey stick handle 12 and/or hockey blade 14 become damaged or unusable, screw 20 is removed and the damaged member is easily replaced.

It should be appreciated that the mold sections 100 and 102 need not necessarily be provided with the protrusions 112 and 126. In this case, the shank is formed as a solid member that when provided with an appropriate size reduction will mate inside the hollow handle 12 to provide the complete hockey stick 10.

It is appreciated that various modifications to the inventive concepts described herein may be apparent to those skilled in the art without departing from the spirit and scope of the invention and we do not wish to be restricted to the specific form shown or uses mentioned, except as defined in the accompanying claims.

What is claimed is:

1. A hollow, elongated handle means serving as a game stick, the handle means having a uniform cross-sectional configuration substantially throughout its length and comprising a pair of opposed first walls having non-planar outer faces and a pair of opposed second walls having generally planar outer faces, wherein the first walls are broader than the second walls with the first walls and the second walls being joined by rounded corner portions to define a substantially rectangular cross-section, and wherein the handle means defines a hollow area with the first walls comprising non-planar inner faces similar to the shape of the non-planar outer faces to provide the opposed first walls with a generally uniform wall thickness extending to and joining with the corner portions, wherein the corner portions have a wall thickness greater than the generally uniform wall thickness of the opposed first walls and with the wall thickness of the corner portions joined to the opposed second walls by a gradually decreasing taper along the inner surface of the second walls to a midpoint of the second walls such that the second walls have a non-uniform cross-section extending from the corner portions to the wall thickness at the midpoint of the second walls, which midpoint wall thickness is less than the wall thickness of the corner portions.

2. The handle means of claim 1 wherein the wall thickness at the midpoint of the second walls is greater than the uniform wall thickness of the first walls.

3. The handle means of claim 1 wherein the first walls have convex outer faces and concave inner faces to provide the generally uniform wall thickness for the first walls.

* * * * *